10/15/85 13 OR 4,547,232

United States Patent [19]

Cartwright

[11] Patent Number: 4,547,232

[45] Date of Patent: Oct. 15, 1985

[54] SENSITIZATION OF WATER-IN-OIL EMULSION EXPLOSIVES

[75] Inventor: Richard V. Cartwright, Wantage Township, Sussex County, N.J.

[73] Assignee: Hercules Incorporated, Wilmington, Del.

[21] Appl. No.: 653,995

[22] Filed: Sep. 24, 1984

[51] Int. Cl.[4] ..... C06B 45/00

[52] U.S. Cl. ..... 149/2; 149/45; 149/48; 149/50; 149/64; 149/65; 149/75; 149/76; 149/79; 149/88; 149/94; 149/95; 149/96; 149/97; 149/98; 149/99; 149/100

[58] Field of Search ..... 149/2, 45, 48, 50, 64, 149/65, 75, 76, 79, 88, 94, 95, 96, 97, 98, 99, 100

[56] References Cited

U.S. PATENT DOCUMENTS

| | | | |
|---|---|---|---|
| 3,212,945 | 10/1965 | Berthmann et al. | 149/51 |
| 3,356,547 | 12/1967 | Berthmann et al. | 149/51 |
| 3,423,256 | 1/1969 | Griffith | 149/2 |
| 3,447,978 | 6/1969 | Bluhm | 149/2 |
| 3,489,623 | 1/1970 | Griffith et al. | 149/20 |
| 3,580,750 | 5/1971 | Griffith | 149/38 |
| 3,580,752 | 5/1971 | Griffith | 149/38 |
| 3,668,027 | 6/1972 | Gay | 149/95 |
| 3,770,552 | 4/1972 | Tomic | 149/2 |
| 4,008,110 | 2/1977 | Machacek | 149/38 |
| 4,014,655 | 3/1977 | Brumberg | 149/47 |
| 4,031,172 | 6/1977 | Zeigler | 149/96 |
| 4,141,766 | 2/1979 | Cameron et al. | 149/21 |
| 4,371,409 | 2/1983 | Cartwright et al. | 149/94 |

FOREIGN PATENT DOCUMENTS 56017995 2/1981 Japan .

*Primary Examiner*—Stephen J. Lechert, Jr.

[57] ABSTRACT

A high density emulsion blasting agent and method is provided for increasing volume energy and optimizing booster sensitivity of water-in-oil emulsion blasting agents without loss of desirable handling characteristics of invert emulsions by utilizing an effective amount of a special sensitizing formulation in total or partial substitution for gas entraining density control agents.

16 Claims, No Drawings

SENSITIZATION OF WATER-IN-OIL EMULSION EXPLOSIVES

This invention relates to a method for minimizing deep hole pressure effects through the use of high density emulsion blasting compositions containing a sensitizing formulation capable of optimizing desirable but essentially incompatible characteristics, inclusive of booster sensitivity and high volume energy, while minimizing use of entrained or occluded gas or similar density control agents.

BACKGROUND

Within the last two decades there has been a substantial shift in demand away from traditional explosive compositions such as TNT, dynamite, and nitroglycerin for hard rock mining, excavation, and similar commercial blasting, in favor of cheaper, readily available inorganic oxygen-supplying salts such as prilled ammonium nitrate (AN) or mixtures of such salt(s) with an organic fuel or oil (ANFO).

Such formulations are relatively inexpensive, can be manufactured "in situ" with greater safety than most traditional explosives, and also avoid a number of problems generally associated with explosive storage and transportation in the field.

If a bore hole is to be very deep and/or wet, however, AN and ANFO formulations are less attractive, since they are easily desensitized and require protection (a) by special packaging with attendant cost and oxygen-balance problems, or (b) by the addition of expensive coatings and the like. Moreover, ANFO has a limited volume energy due to its relatively low bulk density.

The burden of some of the above-listed problems is softened by using explosive slurries having high bulk densities, but such formulations are still not water proof, and must rely heavily upon gassification or other known density control means to retain even a minimally acceptable level of sensitivity. Moreover, pressure conditions within deep bore holes can cause compression of gas bubbles, resulting in retention of unexploded charges in difficult-to-reach areas where further drilling, mining or excavation may be necessary.

One substantial breakthrough with respect to the problem of moisture resistance is described, for instance, in U.S. Pat. No. 3,161,551 of Egly. Here a water-resistant blasting agent is obtained by combining at least one solid prilled inorganic oxygen supplying salt such as ammonium nitrate (AN) with an invert emulsion containing 50–70% aqueous ammonium nitrate (AN) solution as the discontinuous phase and a carbonaceous fuel oil plus organic emulsifier such as a long chain fatty acid or ester derivatives thereof, as the continuous external hydrophobic phase.

Egly's class of compositions exhibit improved resistance to water because the water-in-oil emulsion has the capacity to fill natural voids in the solid prilled inorganic salt component and water cannot easily force its way through the continuous external hydrophobic emulsion phase. Balanced against such advantage, however, are serious sensitivity and storage problems which appear to be due, in part, to a tendency of the solid oxidizer salt component to promote or encourage desensitizing crystallization within the discontinuous aqueous phase during storage.

Additional variations in the use of oxidizer salts in invert emulsion explosives are demonstrated, for instance, in Wade (U.S. Pat. Nos. 4,149,916; 4,110,134) Sudweeks (U.S. Pat. No. 4,322,258) and Jessop (U.S. Pat. No. 4,356,044). Generally speaking, such compositions also tend to be deficient in sensitivity characteristics.

Bluhm (U.S. Pat. No. 3,447,978) represents an attempt to avoid such lack of sensitivity by the use of at least 4% by volume of occluded or entrained gas within an invert emulsion system. Bluhm's compositions consist essentially of (1) a known water-in-oil emulsifier;

(2) a discontinuous ammonium nitrate aqueous phase (optionally supplemented by other water soluble oxidizer salts) within a continuous organic phase consisting of a carbonaceous fuel having the required predetermined gas-retaining consistency at 70° F.; and (3) a functionally important amount of occluded gas such as air in the form of bubbles or hollow glass globules and the like, as density control agents.

Such explosive compositions, while capable of avoiding a number of deep wet-bore hole problems, suffer from deficiencies in stability and sensitivity and face potential pollution problems unless the proportion by weight of discontinuous aqueous phase-to-continuous organic phase is kept high enough to approximate an Oxygen Balance. Moreover, the low density of such compositions results in less than optimal volume energy value ranges.

In the Tomic Patent (U.S. Pat. No. 3,770,522), gas bubbles and other density control agents such as microballoons are proposed along with use of a stearate salt as emulsifier, plus aluminum, magnesium, and smokeless powder as supplementary fuels. Such use of supplementary fuels, however, does not lead to a high volume-energy range as desired.

Efforts to lessen or eliminate density control agents to increase volume energy and reduce cost of production have not been satisfactory because of continued substantial difficulty in controlled firing of such compositions. Moreover, the use of known temperature-sensitive explosive sensitizers such as nitroglycerin tend to improve sensitivity at the expense of safe handling characteristics normally expected of emulsion blasting agents. Sensitizer compositions of later type are described, for instance, in Berthmann et al (U.S. Pat. No. 3,356,547).

It is an object of the present invention to optimize volume energy and sensitivity of high density invert emulsion blasting compositions while retaining the excellent formulation, handling, and safety characteristics generally attributable to water-in-oil emulsion blasting compositions by adding an effective amount of a sensitizing formulation.

It is a further object to optimize volume-energy release characteristics and resistance to deep hole pressure effects of high density invert emulsion containing blasting compositions while retaining sensitivity.

THE INVENTION

The above objects are obtained by utilization of a high density emulsion blasting composition comprising (A) an invert water-in-oil emulsion having a continuous hydrophobic organic phase comprising an emulsifier, a hydrocarbon or carbonaceous fuel component, and a discontinuous aqueous phase comprising at least one soluble inorganic oxidizer salt;

(B) an effective amount of a sensitizing formulation comprising by weight
  (a) about 4–80% by weight of formulation of a polynitrate ester of a 2–5 carbon polyhydric alcohol,
  (b) about 0.5%–8% of nitrocellulose,
  (c) about 10–60% of ammonium nitrate,
  (d) up to 20% of particulate carbonaceous solids,
  (e) up to 45% of sodium chloride, and
  (f) up to 74% of sodium nitrate; and
(C) up to 20% by composition volume of a density control agent.

The term "high density emulsion blasting composition" for purposes of the present invention, includes a composition having density greater than about 1.30 gm/ml and preferably within the range of about 1.30–1.45 gm/ml, the denser ranges favoring higher volume energy but requiring use of a corresponding higher concentration of sensitizing formulation in the blasting composition.

For purposes of the present invention, the continuous hydrophobic organic phase of the water-in-oil emulsion component usually comprises a hydrocarbon or carbonaceous fuel component which can be generally characterized as a liquid or a solid, provided the fuel is liquid under emulsion preparation conditions. Such a continuous hydrophobic organic phase can vary substantially, including, for instance, diesel oil; paraffin oils; paraffin waxes; tall oil; long chain fatty acids such as oleic acid; nitro alkanes such as nitro propane; aromatic hydrocarbons such as benzene, inclusive of substituted aromatic hydrocarbons such as toluene, xylene, nitro benzene, and the like.

The discontinuous aqueous phase of the invert water-in-oil emulsion is usefully a concentrated salt solution, containing up to about 90% by weight of an inorganic oxidizer salt such as ammonium nitrate, alone or in combination with one or more alkali or other metal nitrates or chlorates exemplified by sodium nitrate, sodium chlorate, sodium perchlorate, calcium nitrate, calcium chlorate, calcium perchlorate, potassium nitrate, potassium chlorate, potassium perchlorate, ammonium nitrate, ammonium chlorate, ammonium perchlorate, lithium nitrate, lithium chlorate, lithium perchlorate, magnesium nitrate, magnesium chlorate, aluminum chlorate, barium nitrate, barium chlorate, barium perchlorate, zinc nitrate, zinc chlorate and zinc perchlorate and the like.

For purposes of the present invention, the amount of water in the discontinuous aqueous phase of the emulsion component can constitute about 5–30 weight percent, and preferably about 10–20 weight percent of the total composition.

The continuous organic phase, as above described, is preferably present in an amount such that combination with the oxidizer salt(s) of the aqueous phase plus any required packaging or wrapping is sufficient to achieve an oxygen balance between about −20 to +30%, and preferably about 0%±5% to effectively control the production of undesired explosion by-products. Such continuous organic phase conveniently constitutes about 2–12% by weight, based on total blasing composition.

An emulsifier, for purposes of the present invention, can be of the usual water-in-oil type, and can be used alone or in combination. Such may include, for instance, sorbitol or sorbitan esters, such as sorbitan fatty acid esters, including sorbitan monolaurate, sorbitan monoleate, sorbitan sesquioleate, and sorbitan tristearate among others. Also included are polyoxyethylene sorbitol or sorbitan esters, lower alkyl esters of lanolin fatty acids, polyalkylene esters, substituted oxazolines, phosphate esters of fatty alcohols, and fatty alkanolamides.

In addition, various blends of water-in-oil and oil-in-water emulsifiers can be used so long as the resulting emulsion is of the water-in-oil type. Generally, such emulsifier component can be employed in an active amount varying from about 0.5–7 weight percent based on composition or higher.

An "effective amount" of sensitizing formulation "(B)" for use in the high density emulsion blasting composition of this invention consists of about 10–30 weight percent based on blasting composition while the corresponding emulsion component "(A)" can vary from about 90%–70% or less depending upon the presence or absence of density control agent "(C)" and additional optional components such as talc (about 1–2%), borax (about 20–36%), glycerin (about 1–2%), sulfur (about 1–3%), dinitrotoluene (about 1–3%), trinitrotoluene (about 2–4%), as well as antiacid materials such as calcuim carbonate, zinc oxide (about 0.5%–2%) and the like, the percentage ranges indicated being on a weight basis and not in substitution of other components specifically listed above.

By way of example, the sensitizing formulation of the present invention can utilize, as the poly nitrate ester, one or more of trimethylolethane trinitrate, diethylene glycol dinitrate, nitroglycerin, nitroglycol, and mixtures thereof, preferably trimethylolethane trinitrate and diethylene glycol dinitrate.

Nitrocellulose, for purposes of this invention, is preferably explosive grade nitrocellulose (i.e. unbleached or slightly bleached long fiber cotton) as commonly used in the explosives art. Preparation of such material is disclosed, for instance, in Volume 2, pages 362–413 of "Chemistry and Technology of Explosives" first edition, by Urbanski; Pergamon Press 1965.

Additional art-recognized additives such as particulate carbonaceous solids such as woodmeal, starch, bagasse, fine wheat flour, nut meal, and the like, also one or more gelation accelerators, etc., are includable as part of the sensitizing formulation within the present invention.

The amount of sodium nitrate and sodium chloride components used in the sensitizing formulation can vary within the ranges indicated above inclusive of 0%, the preferred amount depending essentially upon the density desired (i.e. energy/volume) in the final product and the amount of organic material (inclusive of packaging and continuous organic emulsion phase) present in the final product.

While the instant invention relates primarily to high density emulsion blasting compositions and discourages the extensive use of known density control agents such as hollow or porous particles including glass spheres, styrofoam beads, plastic microballoons, fused or sintered agglomerates and the like, this does not preclude the optional use of relatively small amounts of density control components within the range of up to about 20% by composition volume and preferably within the range of 0%–3% by volume when relatively long exposure, under deep hole conditions, is anticipated prior to firing the composition, or when heat or other ambient conditions limit the amount or use of the most efficient nitrate ester in the sensitizing formulation.

In addition, the nature of the final product is also usefully varied by reducing the volume of aqueous solution in the emulsion component and increasing the amount of sensitizing formulation to obtain a cap-sensitive composition.

The following specific examples further illustrate the present invention without, however, limiting the underlying principles or scope of the invention. In the examples, the parts and percentages are by weight unless otherwise specified.

EXAMPLE 1 (CONTROL)

To 18.62 parts water are added 58.71 parts ammonium nitrate and 17.67 parts sodium nitrate. The mixture is heated to 80° C. and stirred to dissolve the solid ingredients. In a separate mix bowl, 3.25 parts mineral oil, 1.25 parts sesquioleate, and 0.50 parts oleic diethanolamide are blended together at 80° C. The above aqueous phase is slowly added to the oil phase and stirred by a propeller agitator at 400 rpm until an water-in-oil emulsion is formed. This emulsion is then thickened by pumping through an homogenizer.***

***Hydroshear, manufactured by Gaulin Corporation, Everett, MA.

The resulting composition is found to have a density of 1.44 g/ml at room temperature, and cannot be detonated using 350 gm of pentolite at 40° F. By commercial standards, its sensitivity is too low for an acceptable blasting agent. This and subsequent tests are reported in Table I infra.

EXAMPLE 2

To 70 parts by weight of the emulsion composition of Example 1 is added 30 parts of Sensitizing Formula A as described below. The resulting product is blended slowly by hand and then mixed using a wooden paddle until uniform. The composition is then packed into cylinders 3 inches in diameter and 6 inches in length for sensitivity testing at 40° F. Test results are reported in Table I infra.

SENSITIZING FORMULATION A*[1]

| Ingredients | Parts/wt. |
|---|---|
| Trimethylolethane trinitrate | 31.95 |
| Diethylene glycol dinitrate | 31.95 |
| N,N—dimethylformamide | 0.1 |
| Nitrocellulose | 4.0 |
| Ammonium nitrate | 28.5 |
| Wood flour | 2.0 |
| Calcium carbonate | 1.0 |
| Density Control Agent*[2] | 0.5 |

*[1]Obtained by premixing liquid ingredients with nitrocellulose component for 3 minutes in a Schrader Bowl and then adding remaining dry ingredients and mixing for 10 minutes.

*[2]Gas filled vinylidene dichloride/acrylonitrile copolymer spheres obtainable commercially under the trademark Miralite 177 ®, a trademark of Pierce & Stevens Chemical Corp., Buffalo, N.Y.

EXAMPLE 3

Eighty-five parts by weight of the composition of Example 1 is blended with 15 parts by weight of the sensitizing formulation of Formula A in the manner described in Example 2. The resulting composition, having a density of 1.34 g/ml at room temperature, is then tested and the test results reported in Table I.

EXAMPLE 4 (CONTROL)

To 16.15 parts by weight of water is added 78.85 parts ammonium nitrate. The mixture is then heated to 80° C. and further stirred to dissolve the salt. In a separate mix bowl, 3.25 parts mineral oil, 1.25 parts sorbitan sesquioleate, and 0.50 parts oleic diethanolamide are blended at 80° C. The aqueous solution is then slowly added to the oil blend and stirred with a propeller agitator until a water-in-oil emulsion is formed. The emulsion is then thickened by pumping through an homogenizer as in Example 1 and tested as before, results being reported in Table I.

EXAMPLE 5

To 70 parts by weight emulsion prepared as in Example 4 is added 30 parts of Sensitizing Formula A. Stirring and thickening is carried out as before, and the product tested and reported in Table I.

EXAMPLE 6

To 85 parts by weight emulsion prepared as in Example 4 is added 15 parts of Sensitizing Formula A. The components are blended as before to obtain a product composition having a density of 1.35 g/ml at room temperature. The product composition is then tested and reported in Table I.

EXAMPLE 7

To 11.4 parts by weight water is added 64.6 parts ammonium nitrate and 19 parts sodium nitrate, the mixture is then heated to 80° C. with gentle stirring to form a salt solution. In a separate mix bowl, 3.25 parts mineral oil, 1.25 parts sorbitan sesquioleate, and 0.50 parts oleic diethanolamide are blended at 80° C. The aqueous salt solution is then slowly added to the organic blend and stirred using a propeller agitator until a water-in-oil emulsion is formed. The resulting emulsion is then thickened by pumping through an homogenizer as in Example 1. To 85 parts of the thickened emulsion is added 15 parts Sensitizing Formula A and mixed as before. The resulting composition, having a density of 1.39 g/ml at room temperature, is tested as before, and the test results reported in Table I.

EXAMPLE 8

Ninety parts of the emulsion prepared in the manner of Example 7 is blended with 10 parts Sensitizing Formula A. The resulting composition is tested as before and reported in Table I.

EXAMPLE 9

Seventy parts of emulsion composition prepared in the manner of Example 7 is blended with 30 parts Sensitizing Formula A to obtain a blasting composition having a density of 1.29 g/ml at room temperature. The product composition is tested as before and the results reported in Table I.

EXAMPLE 10

Seventy parts of emulsion composition prepared as described in Example 7 is blended with 30 parts Sensitizing Formula B as described below. The resulting product, having a density of 1.34 g/ml at room temperature, is found to be detonatable using a #4 fractional blasting cap at 40° F. Test results are reported in Table I.

SENSITIZING FORMULA B*[1]

| Ingredients | Parts/wt. |
|---|---|
| Trimethylolethane trinitrate | 36.205 |
| Diethylene glycol dinitrate | 36.205 |

-continued

| SENSITIZING FORMULA B*[1] | |
|---|---|
| Ingredients | Parts/wt. |
| N,N—dimethylforamide | 0.11 |
| Nitrocellulose | 4.53 |
| Sodium nitrate | 19.11 |
| Wood flour | 2.27 |
| Calcium carbonate | 1.0 |
| Density Control Agent*[2] | 0.57 |

*[1]See p. 9.
*[2]See p. 9.

TABLE I

| Example | Density (gm/CC at Room Temp.) | Emulsion Organic Phase (pt/wt.)** | Emulsion Aqueous Phase (pt/wt.)** | Sensitizer Formulation | Sensitivity* | Specific Energy (cal/gm) | Detonation Rate (m/sec.) |
|---|---|---|---|---|---|---|---|
| 1 (Control) | 1.44 | Mineral Oil (3.25) Sorbitan Sesquioleate (1.25) Oleic diethanolamide (.50) | AN (58.71) $NaNO_3$(17.67) | O | ND (350 gm) | — | — |
| 2 | 1.31 | Same as 1 | Same as 1 | Formula A (30 pt.) | D (10 gm) | 675 | 4650 |
| 3 | 1.34 | Same as 2 | Same as 2 | Formula A (15 pt.) | D (150 gm) | 657 | 4500 |
| 4 (Control) | 1.45 | Mineral Oil (3.25) Sorbitan Sesquioleate (1.25) Oleic Diethanolamide (0.5) | AN (78.85) | O | ND (150 gm) | — | — |
| 5 | 1.31 | Same as 4 | Same as 4 | Formula A (30 pt.) | D (10 gm) | 706 | 4500 |
| 6 | 1.35 | Same as 4 | Same as 4 | Formula A (15 pt.) | D (10 gm) | 699 | 4250 |
| 7 | 1.39 | Same as 6 | AN (64.6) $NaNO_3$(19) | Formula A (15 pt.) | D (150 gm) | 685 | 4100 |
| 8 | 1.42 | Same as 7 | Same as 7 | Formula A (10 pt.) | D (150 gm) | 679 | 3800 |
| 9 | 1.29 | Same as 7 | Same as 7 | Formula A (30 pt.) | D (#5 cap) | 704 | 4550 |
| 10 | 1.34 | Same as 7 | Same as 7 | Formula B (30 pt.) | D (#4 cap) | 699 | 4400 |

*D = detonable
ND = not detonable at primer strength shown
Primers of 150 g–350 g use Pentolite
Primers of 10 g use extruded pentaerythritol tetranitrate/rubber formulation
**Parts by weight based on final composition

What I claim and desire to protect by Letters Patent is:

1. A high density emulsion blasting composition comprising (A) an invert water-in-oil emulsion having a continuous hydrophobic organic phase comprising an emulsifier, a hydrocarbon or carbonaceous fuel component, and a discontinuous aqueous phase comprising at least one soluble inorganic oxidizer salt;

(B) an effective amount of a sensitizing formulation comprising (a) about 4–80% by weight of formulation of a polynitrate ester of a 2–5 carbon polyhydric alcohol, (b) about 0.5%–8% by weight of nitrocellulose, (c) about 10–60% by weight of ammonium nitrate, (d) up to 20% by weight of particulate carbonaceous solids, (e) up to 45% by weight of sodium chloride, (f) up to 74% by weight of sodium nitrate; and (C) up to about 20% by composition volume of a density control agent.

2. The emulsion blasting agent of claim 1 wherein the density of the emulsion blasting composition is greater than about 1.30 gm/ml.

3. The composition of claim 2 wherein the soluble inorganic oxidizer salt comprises ammonium nitrate alone or in combination with at least one member selected from the group consisting of sodium nitrate, sodium chlorate, sodium perchlorate, calcium nitrate, calcium chlorate, calcium perchlorate, potassium nitrate, potassium chlorate, potassium perchlorate, ammonium nitrate, ammonium chlorate, ammonium perchlorate, lithium nitrate, lithium chlorate, lithium perchlorate, magnesium nitrate, magnesium chlorate, aluminum chlorate, barium nitrate, barium chlorate, barium perchlorate, zinc nitrate, zinc chlorate and zinc perchlorate.

4. The blasting composition of claim 1 wherein the sensitizing formulation is present in the amount of about 10–30 weight percent based on blasting composition.

5. The blasting composition of claim 2 wherein the polynitrate ester component of the sensitizing formulation is at least one member selected from the group consisting of trimethylolethane trinitrate, nitroglycol, diethylene glycol dinitrate, and nitroglycerin.

6. The blasting composition of claim 1 containing at least one additional component selected from the group consisting of talc, borax, glycerin, sulfur, dinitrotoluene, trinitrotoluene, calcium carbonate and zinc oxide.

7. The composition of claim 3 wherein a combination of emulsifiers is utilized.

8. The composition of claim 1 wherein the sensitizing formulation contains at least one gelation accelerator component.

9. A method for optimizing volume energy and sensitivity of a high density invert emulsion blasting composition comprising adding an effective amount of the sensitizing formulation defined in claim 1.

10. A method for optimizing volume energy and retaining sensitivity of a high density invert emulsion blasting composition comprising adding an effective amount of a sensitizing formulation defined in claim 2.

11. A method for optimizing volume energy and retaining sensitivity of a high density invert emulsion blasting composition comprising adding an effective amount of a sensitizing formulation defined in claim 3.

12. A method for optimizing volume energy and retaining sensitivity of a high density invert emulsion blasting composition comprising adding an effective amount of a sensitizing formulation defined in claim 4.

13. A method for optimizing volume energy and retaining sensitivity of a high density invert emulsion blasting composition comprising adding an effective amount of a sensitizing formulation defined in claim 5.

14. A method for optimizing volume energy and retaining sensitivity of a high density invert emulsion blasting composition comprising adding an effective amount of a sensitizing formulation defined in claim 6.

15. A method for optimizing volume energy and retaining sensitivity of a high density invert emulsion blasting composition comprising adding an effective amount of a sensitizing formulation defined in claim 7.

16. A method for optimizing volume energy and retaining sensitivity of a high density invert emulsion blasting composition comprising adding an effective amount of a sensitizing formulation defined in claim 8.

* * * * *